United States Patent [19]

Egli et al.

[11] 4,218,050

[45] Aug. 19, 1980

[54] APPARATUS AND METHODS FOR AUTOMATICALLY LINING CONTAINERS, ESPECIALLY CASTING LADLES

[75] Inventors: Ernst Egli, Dietikon; Nino Bombelli, Urdorf; Max Misteli, Aetingen, all of Switzerland

[73] Assignees: Spribag Aktiengesellschaft, Widen-Mutschellen; Von Roll AG, Gerlafingen, both of Switzerland

[21] Appl. No.: 943,485

[22] Filed: Sep. 18, 1978

Related U.S. Application Data

[62] Division of Ser. No. 632,915, Nov. 18, 1975, Pat. No. 4,140,459.

[30] Foreign Application Priority Data

Nov. 22, 1974 [CH] Switzerland ..... 15589/74

[51] Int. Cl.[2] ..... F27D 1/16

[52] U.S. Cl. ..... 266/281; 264/30; 425/60; 425/431; 425/456

[58] Field of Search ..... 264/30; 425/431, 60, 425/456; 266/281

[56] References Cited

FOREIGN PATENT DOCUMENTS 1267387 11/1968 Fed. Rep. of Germany ..... 425/431

*Primary Examiner*—Thomas P. Pavelko

*Attorney, Agent, or Firm*—Finnegan, Henderson, Farabow, Garrett & Dunner

[57] ABSTRACT

Disclosed is apparatus for automatically lining a vessel. With a template inside the vessel, pouring and ramming stations are disposed within the annular space defined by the template and vessel for rotation about the central axis of the vessel. The ramming stations include rams movable in a radially inward direction to compact the lining material at the bottom of the vessel and movable outwardly to compact the material forming the side walls of the vessel.

6 Claims, 7 Drawing Figures

APPARATUS AND METHODS FOR AUTOMATICALLY LINING CONTAINERS, ESPECIALLY CASTING LADLES

This is a division of application Ser. No. 632,915, filed Nov. 18, 1975 now U.S. Pat. No. 4,140,459.

The invention relates to equipment for automatically lining containers, especially casting ladles of circular or oval cross section. Particularly, the invention includes a pouring station, a pneumatic ramming station which is vertically movable and connected with said pouring station, and a rotary drive for the pouring and ramming stations, the ramming station carrying compressed air rammers, a number of which are movable radially toward and away from the central axis of the container being lined.

Apparatus and methods for lining containers are known. However, such equipment requires manual operation in whole or in part. These known apparatus and methods suffer from the drawback that ample and even compaction of the material being rammed cannot be reliably achieved since it depends on the care and skill of the operator. Even the smallest improper compaction in practice leads to the premature loss of usefulness of the entire vessel.

In German Pat. No. 1,267,387, there is disclosed lining apparatus which in part eliminates these undesirable effects. However, this apparatus does not allow automatic compaction of the lowermost and most important part of the bottom cone conically toward the vessel midst or its central vertical axis. This further requires conventional manual compaction thereby incurring the abovementioned drawbacks of uneven ramming effects, and the so-called compaction gaps. Further, this known apparatus does not permit lining a vessel in a single operational stage. Rather, it must be done in several stages, the equipment requiring displacement and sideways or lateral shifting upon each stamping phase, so that a new jig or template ring may be installed for the next stamping phase. Then this apparatus must be moved back and centered again. This results in much loss of time and is related to corresponding cost factors of uneconomic nature. Further, apparatus and methods for automatically lining casting ladles are known, for instance the method of slinging, which is carried out with a slinging machine. These machines are exceedingly costly and generate dust in excessive amounts when the material used for lining is being poured, especially when it is sand. This dust is undesired in operation and is a health hazard.

The invention provides apparatus eliminating the above cited and other drawbacks when the containers are being stamped, especially those for metal and steel smelting purposes, and thereby putting to the fullest use the advantages of machine-ramming in the sense of maximum possible homogeneity of the ramming.

In this sense, the present apparatus is characterized in that a pivot system is mounted in the immediate vicinity of or adjacent the rammer foot, the system allowing the ramming units to swing out and toward the central axis of the vessel.

The present invention shows a way of automatically fabricating a homogeneous vessel lining without the compaction in any part of the vessel depending on the skill or reliability of the operator.

The apparatus of the present invention is of such design that the vessels may be homogeneously lined in a single uninterrupted operational stage. Preferably the ramming material reaches the rammers enclosed and in free fall, so that the danger of silicosis is completely eliminated.

The present invention will now be discussed, using the schematic Figures below in illustrative manner:

Figure 1:
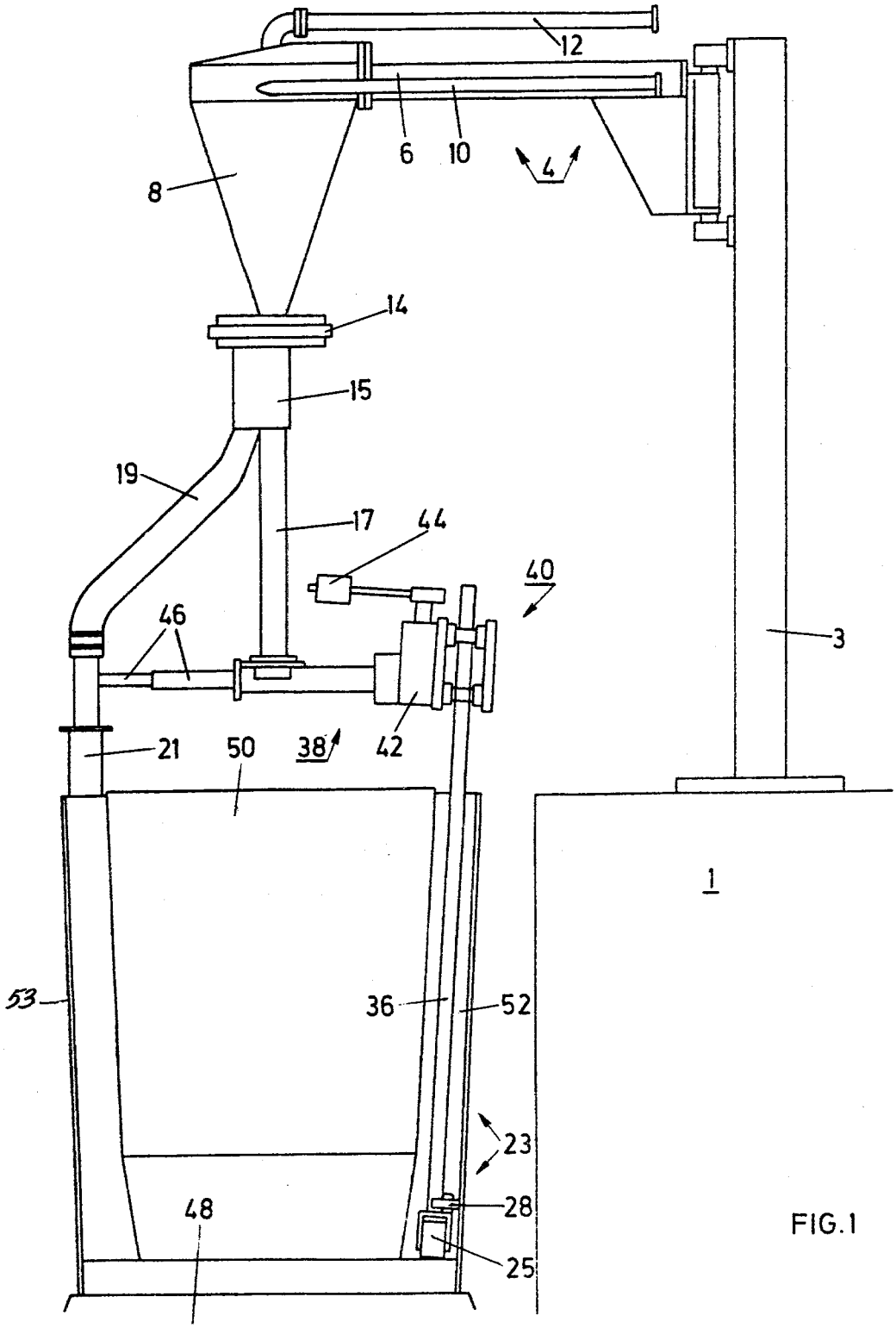
FIG. 1 is a schematic elevational view with parts broken out of a facility or apparatus constructed in accordance with the present invention for automatically lining casting ladles.

Referring to FIG. 1, a vertical post 3 of a revolving crane 4 is mounted on foundation 1. Crane 4 is provided with a boom 6 at the end of which is mounted a separator 8. A supply line 10 for the refractory lining material passes tangentially into separator 8. An automatic filter, not shown, may be directly built into separator 8 as a variation.

An exhaust duct 12 evacuates the air required for the pneumatic conveyance of the lining material and is connected to a dust collection system with suction, not shown. A rotary system 14 with hose-guide and air ducts for the rammers is located underneath separator 8. A support 17 is used to suspend a pipe 21 and also as brace-guide. The exhaust of separator 8 is connected by a hose 19 to telescoping pipe 21. Opposite those means fixing or defining the pouring station is located a ramming station 23 having two control rollers 25, 26 which roll off the poured-in sand or lining substance. Two lateral guide rollers 28 and 29 laterally guide the rammer station 23 to or against the ladle wall 53. As seen in the direction of motion, two rammers 31, 32 are located behind control rollers 25, 26. That is, the rollers 25, 26 precede the rammers 31, 32 as the ramming station rotates as described hereinafter. Rammers 31, 32 are mounted to a structure 34 provided with lines for supplying fluid under pressure to cylinders which provide for extension and retraction of the rams 31 and 32. This fluid system is preferably pneumatic. The sense of rotation also may take place in the opposite serial sequence. A rammer support brace 36 is displaceably supported through a brack guide 40 at section 38. That is, the brace 36 is movable lengthwise along its long axis relative to guide 40. Guide 40 comprises a housing block 42 and a counterweight 44 mounted to block 42. A rod 46 designed to telescope is located at housing block 42. A ladle 53 defines with a template or jig 50 an annular space 52 which, as shown in FIG. 1 is in the process of being lined with sand. The sand surface represents the stamping surface 54 and is used to set the elevation of stampers 31, 32 by means of rollers 25, 26.

The process for automatically lining casting ladles by means of the equipment or apparatus shown in FIGS. 1 and 2 will now be described. The material used for lining, especially sand, is pneumatically removed from a bin, not shown, and passed through supply line 10 into separator 8. In separator 8, the lining material is separated in known manner from the conveying air, which latter, remains charged with very fine particles that were not separated in separator 8. The charged air containing the fine particles is then passed through a dust-removing facility, not shown, before being expelled as clean gas into the atmosphere. The separated lining material reaches the exit at the bottom of separator 8 and passes through hose 19 into telescope pipe 21. Pipe 21 is adjustable in length depending on the height of the ladle rim or for the purpose of rotating the facility. The lining material passes through said pipe at low speed, at most several meters/second, and it does so in free fall, until it hits the bottom of the annular space 52 where it remains, without being flung about. Rotary unit 14, which is powered by a motor, not shown, turns during this filling process, as does telescoping pipe 21 with hose 19, the pipe evenly sweeping annular space 52. Ramming or stamping station 23 rotates simultaneously with the pouring of the lining material and the rotation of the pouring station, because the two stations are connected in radially displaceable manner by spreading station 38. The two control rollers 25, 26 are located up front as seen in direction of motion. They lead the rammers 31, 32 and scan the height of the poured layer of lining material. A rake 27 is provided in front of the two control guides comprised of rollers 25, 26, and even any irregularities in the scattered material.

Because of the elevation of the two control rollers 25 and 26, elevation control of rammers 31, 32 takes place through a parallelogram linkage or a rocker and through spring suspension, so as to absorb vibrations, in a manner which need not be described in detail. The two side guide rollers 28, 29 guide the lower part of ramming station 23, which is free to move within certain limits, to or against the outer wall of the annular space 52 of ladle 53. As the height of the layer of the lining material increases, rammer support brace 36 is lifted together with the lower part of ramming station 23, the brace 36 being displaced upwardly relatively to guide 40. In this manner, the material is compacted, for instance by means of pneumatic rammers 31, 32 behind the pouring station. The pouring station feeds the lining material evenly into annular space 52, and with the trailing rammers renders it feasible to automatically and quickly line ladle 53, in a dust-free atmosphere and without manual intervention. Once the lining has been made, both the telescope pipe 21 and stamper support brace 36 will be lifted until revolving crane 4 may swing outward and ladle 53 becomes free or accessible for further work.

Spreading station 38 allows shifting, i.e., pushing apart or moving together of the pouring station and the ramming station depending on the diameter of ladle 53 in such manner that the axis of rotation of rotary unit 14 will always lie coincident with the central axis of the ladle. This adjustment is done manually. However, it may also be achieved pneumatically or hydraulically by means of a cylinder and piston rod.

Experiments performed with such equipment to automatically line casting ladles have shown that several cubic meters per hour of lining material, in particular sand, may be conveyed for the purpose of lining annular spaces of ladles, may be rammed, done effortlessly and accomplished in the absence of dust. The lining material also may be introduced in a purely mechanical manner, for instance via a vibrating chute. It is feasible to increase the number of stampers in a stamping station.

Figure 3:
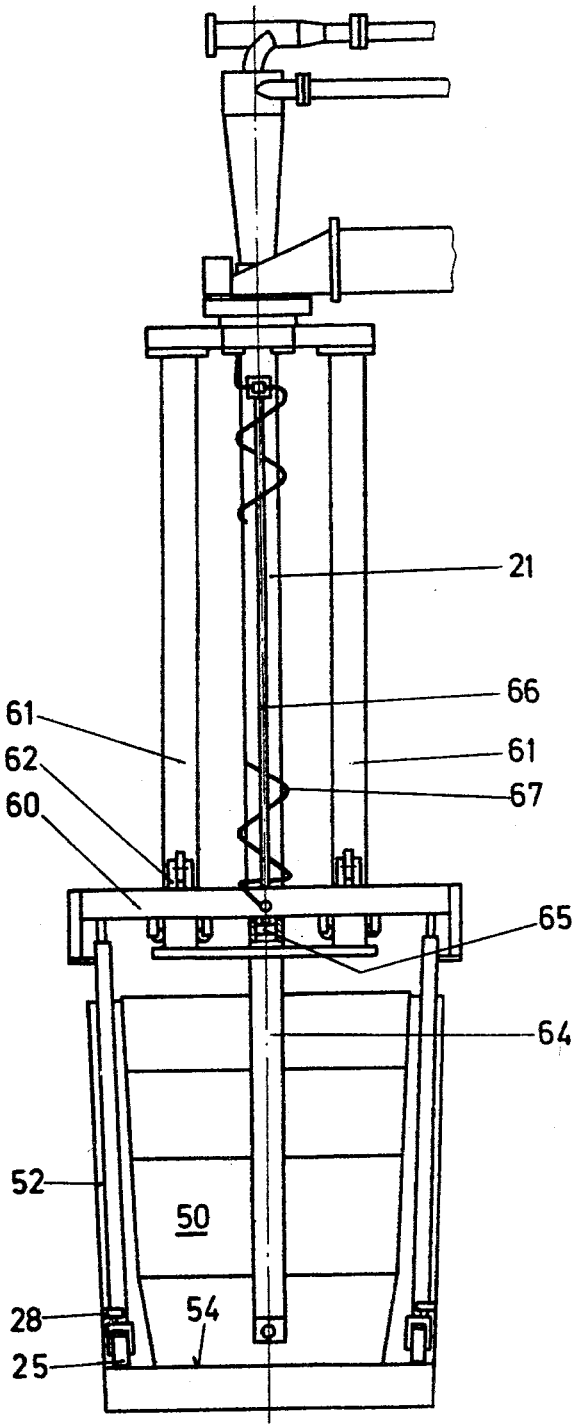
FIG. 3 is a schematic elevational view with parts broken out illustrating another form of facility for lining casting ladles.

The ramming facility shown in FIG. 3 basically corresponds to that of FIG. 1 in design. The same parts are denoted by the same reference numerals in both facilities. Thus the equipment of FIG. 3 shows a telescopic pipe 21 through which lining material falls into the space to be lined, which is denoted as annular space 52. Further, similar control rollers 25 and side guide rollers 28 are illustrated. A template 50 defines with ladle 53 the annular space to be lined. FIG. 3 also shows ramming surface 54.

The ramming equipment in this embodiment is provided with a cross-beam 60 with rollers providing for low friction vertical motion of beam 60 and the ramming system proper along two guide rods or posts 61. The ramming system is symmetrical, so that the resultant of all forces passes through the axis of rotation of ladle 53.

As shown in the center of ladle 53, the equipment includes a lifting cylinder 64, a piston 65 and a piston rod 66 rigidly connected to the facility. A compressed medium supply line 67 for introducing the compressed medium above the piston is illustrated. Since piston 65 is mounted rigidly, lifting cylinder 64 together with cross-beam support 60 and the guide and ramming facilities will lift when there is a supply of compressed medium. Corresponding to the load and pressure in cylinder 64 above piston 65, there will be a lifting force opposing the weight of the facility and allowing to compensate or relieve such weight. The pressure from the control rollers 25 is thus adapted to the substrate to be rammed. In this manner, the ramming process may be optimized, adapted to the particular material introduced, and adapted to the particular dimensions.

Figure 4:
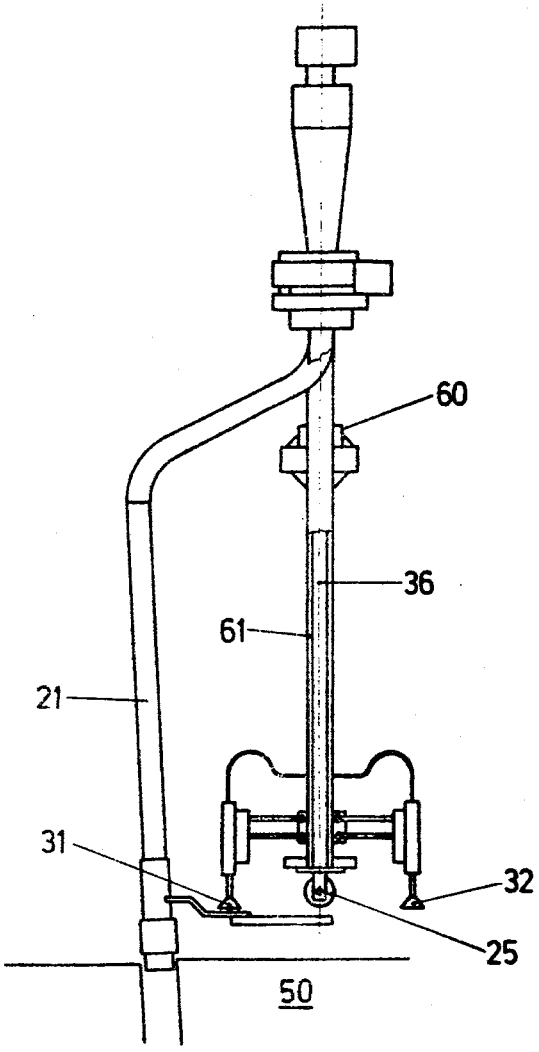
FIG. 4 is an enlarged side elevational view with parts broken out illustrating the ramming facility of FIG. 3, in the moved-out position or position removed from the casting ladle.

FIG. 4 shows the ramming facility in its removed position, i.e. the lifted position above the ladle. This motion takes place by means of lifting cylinder 64 and piston 65.

Since the ladle lining is conically thickened in its lower quarter, at least two rammers must be adjustable in this zone so that the maximum distance between the rammer and the jig or template 50 is not exceeded for which objection-free compaction remains feasible.

The adjustment and withdrawal of the rammers must take place in correspondence to a given height of the rammers in the annular space 52. The control of the two setting cylinders 73 occurs only by means of two different inclines or lifting flanks at guide rods 61.

Figure 7:
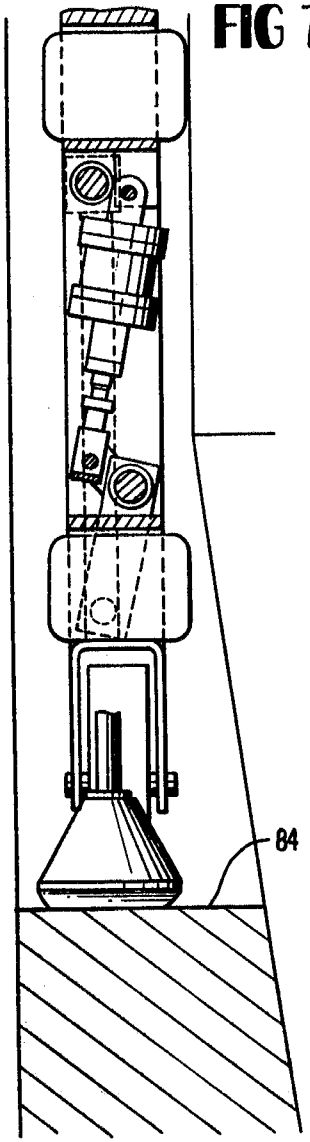
FIG. 7 is a view similar to FIG. 5 illustrating the ramming apparatus in a higher position relative to the bottom of the ladle.
Figure 6:
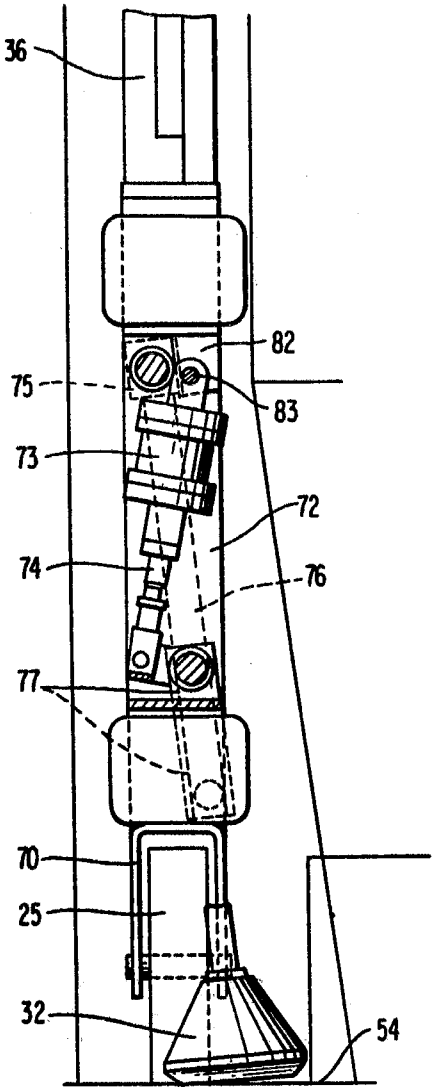
FIG. 6 is an enlarged elevational view with parts broken out of the ramming station illustrated in FIG. 5 in the region of or adjacent its lowermost ramming position at the bottom of the ladle.
Figure 5:
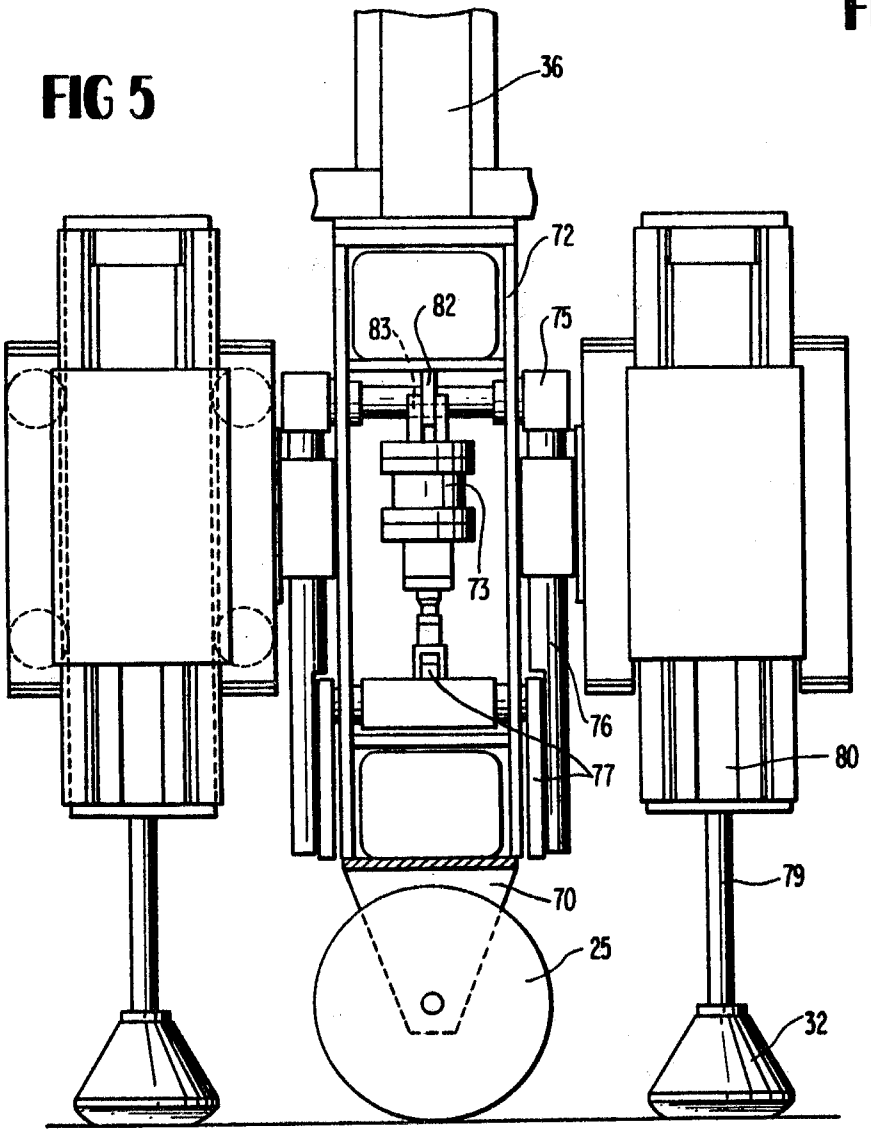
FIG. 5 is an enlarged elevational view of a ramming station.

As illustrated in FIGS. 5, 6 and 7, the control rollers 25 are held by wheel-forks 70. A control block 72, a setting cylinder 73, and a piston rod 74 are mounted to each rammer support brace 36. A support is mounted to the free end of a swivel arm 76. The swivel arm is borne in a pivoting bearing or support 75. A lever 77 is connected with piston rod 74 such that upon loading the setting cylinders 73, its piston will extend piston rod 74 and thereby will move lever 77 with lever arm 76 about the pivot of bearing 75. More particularly, the rammer 32 is connected by a rod 79 to a piston and a ramming cylinder 80. The setting cylinder 73 is pivotally supported at a fishplate 82 by an axle 83. Rammers 31 or 32 are mounted to lever 77, so that moving lever 77 from the lowermost stage into the position of FIG. 5 also will be feasible. In the position illustrated in FIG. 5, the annular space 52 conically flaring downwardly and inwardly may be stamped close to the wall of the jig or template. Ramming surface 54 rises during filling and ramming, rammers 31 and 32 being lifted vertically. In order to prevent engagement or collision between the conical side wall of the jig or template 50 and the rammers, piston rods 74 are retracted upon reaching a higher ramming surface 84 by means of corresponding control of setting cylinder 73. Thus rammers 31 and 32 will pivot away from the wall or jig or template 50. The moment the conical outer surface of jig or template 50 passes into its nearly cylindrical part, piston rod 74 of the remaining rammer facility will be pulled into its null position, so that rammers 31 and 32 will move vertically upward and lie generally parallel to the jig or template outer wall, which advantageously will be of slightly conical design.

Considering that material ramming always must take place in the immediate vicinity of the outer wall of the jig or template, it is feasible in this manner, when the outer surfaces of the jigs or templates are strongly conical or non-cylindrical, to adapt the rammer to the jig or template step-wise. This causes optimum ramming of the material introduced.

In use, the ramming system is lowered under its own weight, the compressed medium expelled from cylinder 64 being throttled, if desired, to control the descent rate. Upward motion is adjusted with respect to the rate of sand being introduced and a degree of load-relief is obtained by a corresponding selected rate of compressed medium supply. For instance, a pressure reducing valve adjusts the pressure in cylinder 64 in such a manner that the compression from roller 25 on the sand may be reduced to a minimal value.

The entire facility may be swung away by lifting the ramming equipment. Thus, the finished, lined ladle may be moved out.

Figure 2:
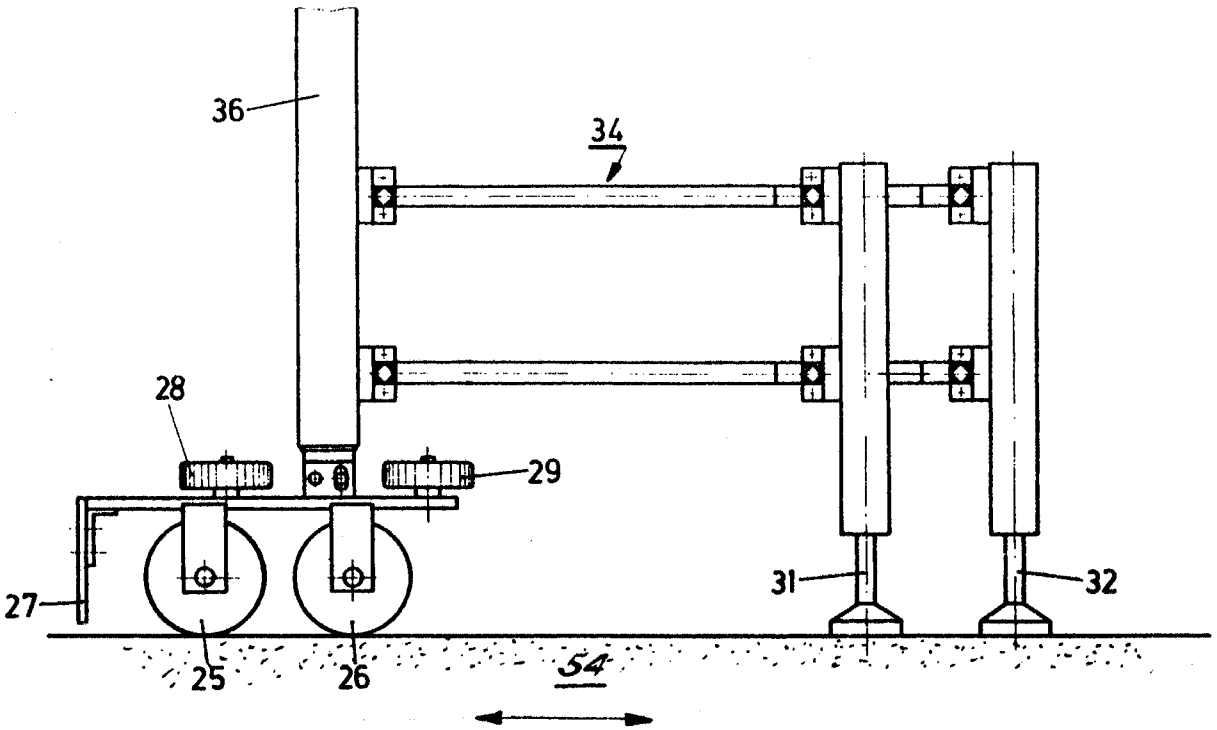
FIG. 2 is an enlarged view of the ramming apparatus looking from right to left in FIG. 1.

Because of the previously discussed special, gliding rammer suspension illustrated in FIG. 2, the rammers may automatically adjust to any irregularity, so that extremly even compaction and hence optimum life of the lining are ensured. A built-in, pressure-sensitive relief system ensures that the system is automatically and continuously lifted as a function of the compacted height.

Because of these simple design elements, the equipment of the present invention may be manufactured in a simpler and more reliable manner, and correspondingly more economically, than the case of equipment belonging to the state of the art.

The life of such vessels depends on the strength and density of the rammed material. The present invention is adaptable to fabrication of all shapes occurring in practice evenly and automatically in one operation. This applies especially to casting ladles of inside surfaces representing frustra of cones when the cones are of different angles.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by U.S. Letters Patent is:

1. Apparatus for lining a vessel having side and bottom walls, said vessel adapted to have a template disposed therein forming a space with said side walls, said apparatus comprising a support, means carried by said support for pouring lining material into said space, means for compacting said lining material including a ram, a narrow elongated member depending downwardly from said support and adapted to extend into said space, means closely positioned laterally adjacent the lower end of said elongated member and supporting said ram, means pivotally coupling said support means and said elongated member one to the other adjacent the lower end of said elongated member, whereby said ram is pivotal about an axis generally transverse to the length of said elongated member.

2. Apparatus according to claim 1 including control guide means at the lower end of said elongated member engageable with the surface of said lining material.

3. Apparatus according to claim 1 wherein said pivotal coupling means includes a lever pivoted on said elongated member and operatively connected to said ram supporting means, and piston and cylinder means on said elongated member operable to pivot said lever.

4. Apparatus according to claim 1 including a fluid system carried by said support for conveying the lining material toward said pouring means, a separator for separating the fluid of the fluid conveying system from the lining material conveyed thereby, said pouring means including a duct carried by the separator for disposition within the vessel.

5. Apparatus according to claim 1 including means for supporting said pouring means and said compacting means for rotation about the central axis of the vessel, means coupled to said support means for rotating said pouring means and said compacting means about the central axis of the vessel, a rake carried by said compacting means and located ahead of said ram and behind said pouring means whereby, upon rotation of said pouring means and said compacting means, said rake smoothes lining material poured into the vessel before the lining material is compacted by said ram.

6. Apparatus according to claim 1 including a fluid actuated lifting system connected to said compaction means, and means carried by said support for relieving the weight of said compaction means on the lining material deposited into the annular space.

* * * * *